US010920572B2

(12) United States Patent
Ratcliffe et al.

(10) Patent No.: US 10,920,572 B2
(45) Date of Patent: Feb. 16, 2021

(54) SENSOR DEPLOYMENT SYSTEM AND METHOD USING A MOVABLE ARM WITH A TELESCOPING SECTION

(71) Applicant: Sondex Wireline Limited, Farnborough (GB)

(72) Inventors: James David Ratcliffe, Farnborough (GB); Timothy Michael Gill, Farnborough (GB); Neil Geoffrey Harris, Farnborough (GB); Ian Hitchcock, Farnborough (GB); Paul Shambrook, Farnborough (GB)

(73) Assignee: Sondex Wireline Limited, Farnborough (GB)

( * ) Notice: Subject to any disclaimer, the term of this patent is extended or adjusted under 35 U.S.C. 154(b) by 76 days.

(21) Appl. No.: 16/013,391

(22) Filed: Jun. 20, 2018

(65) Prior Publication Data

US 2018/0363448 A1 Dec. 20, 2018

Related U.S. Application Data

(60) Provisional application No. 62/522,367, filed on Jun. 20, 2017.

(51) Int. Cl.

| | |
|---|---|
| ***E21B 47/01*** | (2012.01) |
| ***E21B 17/10*** | (2006.01) |
| ***E21B 49/08*** | (2006.01) |

(52) U.S. Cl.

CPC ..... *E21B 47/01* (2013.01); *E21B 17/1021* (2013.01); *E21B 49/08* (2013.01)

(58) Field of Classification Search

CPC ..... E21B 47/01; E21B 17/026; E21B 23/14; E21B 17/1021; E21B 49/08

See application file for complete search history.

(56) References Cited

U.S. PATENT DOCUMENTS 4,184,546 A 1/1980 Nicolas et al.
4,432,143 A * 2/1984 Moriarty ..... E21B 17/1021 250/268

(Continued)

FOREIGN PATENT DOCUMENTS

| | | |
|---|---|---|
| CN | 201090208 | 7/2008 |
| WO | 2016/137462 | 9/2016 |
| WO | 2016/159780 | 10/2016 |

OTHER PUBLICATIONS

"MaxTRAC Downhole Wireline Tractor System," 2018, Schlumberger Limited, https://www.slb.com/services/production/production_logging/conveyance/maxtrac_downhole_well_tractor.aspx.

(Continued)

*Primary Examiner* — Tara Schimpf
*Assistant Examiner* — Jonathan Malikasim
(74) *Attorney, Agent, or Firm* — Hogan Lovells US LLP

(57) ABSTRACT

A sensor deployment system includes a first bulkhead arranged at a first end of a downhole tool, a second bulkhead arranged at a second end of the downhole tool, opposite the first end, a first pivot block arranged proximate the first bulkhead, a second pivot block arranged proximate the second bulkhead, and an arm rotatably coupled to the first and second pivot blocks at opposite ends of the arm. Rotation of at least a portion of the arm drives at least a portion of the arm radially outward from an axis of the downhole tool.

18 Claims, 17 Drawing Sheets

(56) References Cited

U.S. PATENT DOCUMENTS

| | | | | |
|---|---|---|---|---|
| 4,673,890 | A | 6/1987 | Copland | |
| 4,715,440 | A | 12/1987 | Boxell et al. | |
| 4,926,937 | A | 5/1990 | Hademenos | |
| 5,086,645 | A | 2/1992 | Deaton | |
| 5,092,056 | A | 3/1992 | Deaton | |
| 5,548,900 | A | 8/1996 | Hunt-Grubbe | |
| 5,574,263 | A | 11/1996 | Roesner | |
| 6,176,129 | B1 | 1/2001 | Aguesse | |
| 6,454,030 | B1 | 9/2002 | Findley | |
| 6,560,889 | B1 * | 5/2003 | Lechen | E21B 47/08 33/542.1 |
| 6,629,568 | B2 | 10/2003 | Post et al. | |
| 6,910,533 | B2 | 6/2005 | Guerrero | |
| 6,920,936 | B2 | 7/2005 | Sheiretov et al. | |
| 7,114,386 | B1 | 10/2006 | Veignat et al. | |
| 7,281,578 | B2 | 10/2007 | Nakajima et al. | |
| 7,293,746 | B2 | 11/2007 | Brundage | |
| 7,334,642 | B2 | 2/2008 | Doering et al. | |
| 7,543,512 | B2 | 6/2009 | Smith | |
| 7,694,735 | B2 | 4/2010 | Haheim et al. | |
| 7,954,563 | B2 | 6/2011 | Mock et al. | |
| 8,028,766 | B2 * | 10/2011 | Moore | E21B 4/04 166/216 |
| 8,453,744 | B2 | 6/2013 | Buss | |
| 8,579,037 | B2 | 11/2013 | Jacob | |
| 9,051,823 | B2 * | 6/2015 | Maute | E21B 47/10 |
| 9,097,100 | B2 | 8/2015 | Finke | |
| 9,181,796 | B2 | 11/2015 | Malone | |
| 9,303,478 | B2 | 4/2016 | Scruggs | |
| 9,915,144 | B2 * | 3/2018 | Manzar | E21B 47/102 |
| 2005/0145415 | A1 | 7/2005 | Doering | |
| 2006/0230846 | A1 | 10/2006 | Smith | |
| 2009/0093692 | A1 * | 4/2009 | Hansma | A61B 5/103 600/306 |
| 2011/0127046 | A1 | 6/2011 | Aguirre | |
| 2011/0138903 | A1 | 6/2011 | Large | |
| 2013/0068479 | A1 | 3/2013 | AlDossary | |
| 2014/0352422 | A1 | 12/2014 | Paulsson | |
| 2015/0211312 | A1 | 7/2015 | Krueger | |
| 2016/0053612 | A1 * | 2/2016 | Proett | E21B 49/088 166/264 |
| 2016/0130935 | A1 | 5/2016 | Manzar | |

OTHER PUBLICATIONS

"Multiple Array Production Suite," 2018, General Electric, https://www.geoilandgas.com/oilfield/wireline-technology/multiple-array-production-suite.

International Search Report and Written Opinion dated Oct. 19, 2018 in corresponding PCT Application No. PCT/US2018/038592.

International Search Report and Written Opinion dated Sep. 27, 2018 in corresponding PCT Application No. PCT/US2018/38561.

Office Action dated Nov. 4, 2019 in related U.S. Appl. No. 16/013,407.

Office Action dated Nov. 4, 2019 in related U.S. Appl. No. 16/013,320.

* cited by examiner

SENSOR DEPLOYMENT SYSTEM AND METHOD USING A MOVABLE ARM WITH A TELESCOPING SECTION

CROSS REFERENCE TO RELATED APPLICATION

This application claims priority to and the benefit of: U.S. Provisional Application Ser. No. 62/522,367 filed Jun. 20, 2017, titled "SENSOR DEPLOYMENT MECHANISM SYSTEM AND METHOD," the full disclosure of which is hereby incorporated herein by reference in its entirety for all purposes.

BACKGROUND

1. Field of Invention

This disclosure relates in general to oil and gas tools, and in particular, to systems and methods for sensor deployment from downhole logging tools.

2. Description of the Prior Art

In oil and gas production, various measurements are conducted in wellbores to determine characteristics of a hydrocarbon producing formation. These measurements may be conducted by sensors that are carried into the wellbore on tubulars, for example, drilling pipe, completion tubing, logging tools, etc. Multiple measurements may be performed along different locations in the wellbore and at different circumferential positions. Often, the number of measurements leads to the deployment of several downhole tools, thereby increasing an overall length of the string, which may be unwieldy or expensive.

SUMMARY

Applicant recognized the problems noted above herein and conceived and developed embodiments of systems and methods, according to the present disclosure, for sensor deployment systems.

In an embodiment a sensor deployment system includes a pair of bulkheads arranged along a tool string axis. The system also includes a pair of pivot blocks arranged along the tool string axis, a respective pivot block of the pair of pivot blocks being positioned proximate a respective bulkhead of the pair of bulkheads. The system further includes an arm coupled to the pair of pivot blocks at opposite ends. The arm includes a first segment rotationally coupled to a first pivot block of the pair of pivot blocks. The arm also includes a second segment rotationally coupled to a second pivot block of the pair of pivot blocks. The arm further includes a first link arm coupled to the first pivot block and the first segment. The arm includes a second link arm coupled to the second pivot block and the second segment. The arm further includes a telescoping section extending between the first segment and the second segment, wherein the telescoping section moves radially outward from the tool string axis as the first and second segments rotate about the respective pivot blocks.

In another embodiment a sensor deployment system includes a first bulkhead arranged at a first end of a downhole tool, a second bulkhead arranged at a second end of the downhole tool, opposite the first end, a first pivot block arranged proximate the first bulkhead, a second pivot block arranged proximate the second bulkhead, and an arm rotatably coupled to the first and second pivot blocks at opposite ends of the arm, wherein rotation of at least a portion of the arm drives at least a portion of the arm radially outward from an axis of the downhole tool.

In an embodiment a downhole measurement system includes a bottom hole assembly arranged within a wellbore. The system also includes a conveying member extending from a surface to the bottom hole assembly, the conveying member controlling a position of the bottom hole assembly within the wellbore. The system further includes a downhole tool, the downhole tool being part of the bottom hole assembly and positioning at least one sensor into an annulus of the wellbore. The downhole tool includes a first pivot block arranged at a first end. The downhole tool also includes a second pivot block arranged at a second end, opposite the first end. The downhole tool also includes an arm rotatably coupled to the first and second pivot blocks, wherein rotation of the arm around at least one of the first or second pivot blocks changes a radial position of at least a portion of the arm with respect to a tool axis such that the at least one sensor is positioned within the annulus.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
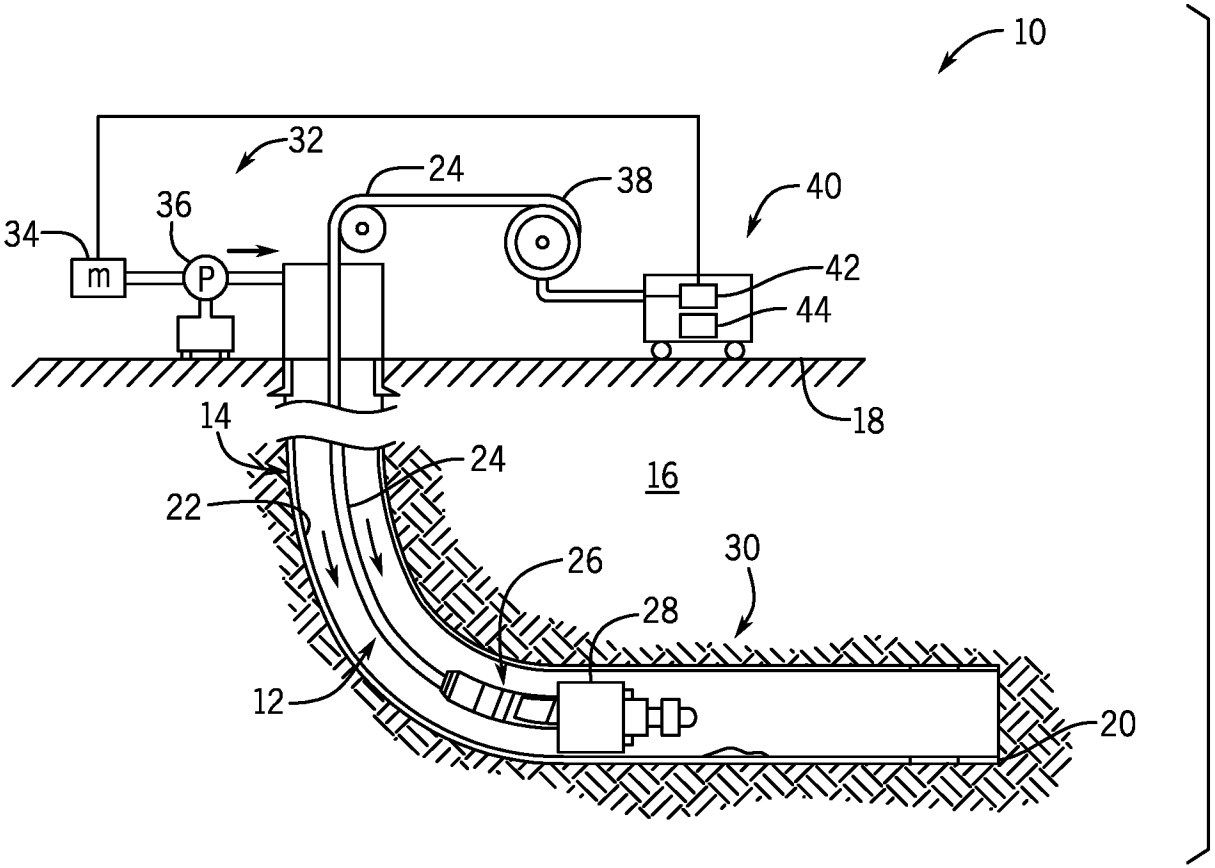
FIG. 1 is a schematic elevation view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure include systems and methods for deploying various sensors into a wellbore annulus from a tool string. In certain embodiments, one or more arms are coupled to a tool string body and driven radially outward from a tool string axis via a biasing member, thereby reducing the presence of an onboard mover, such as a motor. The arms may be rotationally coupled to a pivot block at ends such that a telescoping section of the arms may be driven radially outward from the tool string body to position one or more sensors in the wellbore annulus. In certain embodiments, the telescoping section includes first and second sections that move linearly away from one another, for example via a tongue and fork mechanism or piston and sleeve arrangement, as the arms move radially outward from the tool string axis. In certain embodiments, the pivot blocks coupled to the arms are not axially moveable along the tool string axis, and rather, are fixed in position proximate fixed bulkheads. As a result, more sensors may be arranged on the arms and routed toward the bulkheads for data collection.

FIG. 1 is a schematic elevation view of an embodiment of a wellbore system 10 that includes a work string 12 shown conveyed in a wellbore 14 formed in a formation 16 from a surface location 18 to a depth 20. The wellbore 14 is shown lined with a casing 22, however it should be appreciated that in other embodiments the wellbore 14 may not be cased. In various embodiments, the work string 12 includes a conveying member 24, such as an electric wireline, and a downhole tool or assembly 26 (also referred to as the bottomhole assembly or "BHA") attached to the bottom end of the wireline. The illustrated downhole assembly 26 includes various tools, sensors, measurement devices, communication devices, and the like, which will not all be described for clarity. In various embodiments, the downhole assembly 26 includes a downhole tool 28 having extendable arms, which will be described below, for positioning one or more sensors into the annulus of the wellbore 14. In the illustrated embodiment, the downhole tool 28 is arranged in a horizontal or deviated portion 30 of the wellbore 14, however it should be appreciated that the downhole tool 28 may also be deployed in substantially vertical segments of the wellbore 14.

The illustrated embodiment further includes a fluid pumping system 32 at the surface 18 that includes a motor 34 that drives a pump 36 to pump a fluid from a source into the wellbore 14 via a supply line or conduit. To control the rate of travel of the downhole assembly, tension on the wireline 14 is controlled at a winch 38 on the surface. Thus, the combination of the fluid flow rate and the tension on the wireline may contribute to the travel rate or rate of penetration of the downhole assembly 16 into the wellbore 14. The wireline 14 may be an armored cable that includes conductors for supplying electrical energy (power) to downhole devices and communication links for providing two-way communication between the downhole tool and surface devices. In aspects, a controller 40 at the surface is provided to control the operation of the pump 36 and the winch 38 to control the fluid flow rate into the wellbore and the tension on the wireline 12. In aspects, the controller 40 may be a computer-based system that may include a processor 42, such as a microprocessor, a storage device 44, such as a memory device, and programs and instructions, accessible to the processor for executing the instructions utilizing the data stored in the memory 44.

In various embodiments, the downhole tool 28 may include extendable arms that include one or more sensors attached thereto. The arms enable the sensors to be arranged within the annulus, which may be exposed to a flow of fluid that may include hydrocarbons and the like moving in an upstream direction toward the surface 18. In various embodiments, the arms enable a reduced diameter of the downhole tool 28 during installation and removal procedures while still enabling the sensors to be positioned within the annulus, which may provide improved measurements compared to arranging the sensors proximate the tool body. As will be described below, in various embodiments the sensors may be communicatively coupled to the controller 40, for example via communication through the wireline 24, mud pulse telemetry, wireless communications, wired drill pipe, and the like. Furthermore, it should be appreciated that while various embodiments include the downhole tool 28 incorporated into a wireline system, in other embodiments the downhole tool 28 may be associated with rigid drill pipe, coiled tubing, or any other downhole exploration and production method.

Figure 2:
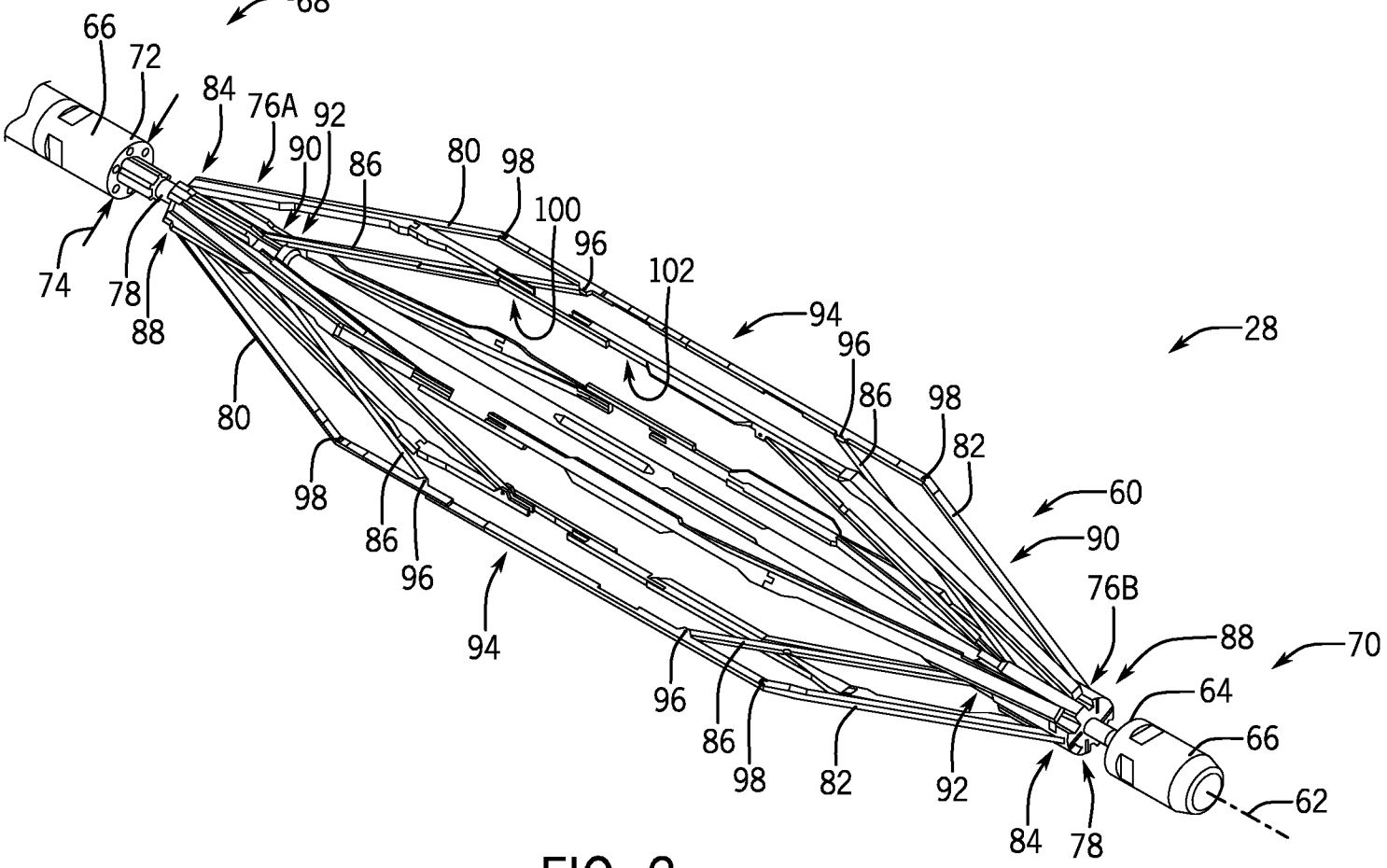
FIG. 2 is an isometric view of an embodiment of a downhole tool, in accordance with embodiments of the present disclosure.

FIG. 2 is an isometric perspective view of an embodiment of the downhole tool 28 including a plurality of extendable arms 60 (e.g., arms) arranged in an extended or deployed position. As illustrated in FIG. 2, the arms 60 are radially displaced from a tool string axis 62. The illustrated embodiment includes six arms 60, but it should be appreciated that in other embodiments more or fewer arms 60 may be included. For example, there may be one, two, three, four, five, ten, or any other reasonable number of arms 60 arranged on the downhole tool 28. In the illustrated embodiment, the arms 60 are arranged circumferentially about a circumference 64 of the tool 28 and are evenly spaced apart. However, in other embodiments, the arms 60 may not be evenly spaced apart. It should be appreciated that the spacing may be particularly selected based on anticipated downhole conditions. By arranging the arms 60 circumferentially about the downhole tool 28, the entire or substantially the entire annulus surrounding the downhole tool 28 may be analyzed using the arms 60 (e.g., using sensors coupled to the arms). Therefore, if flow at an upper portion were different than flow at a lower portion, for example, the different arms 60 would be arranged to monitor and report such flow characteristics to inform future wellbore activities. Furthermore, if fluid compositions were different along the annulus, the arrangement of the sensors circumferentially around the tool 28 may enable detection and measurement of the different fluid characteristics.

In various embodiments, a pair of bulkheads 66 are positioned at first and second ends 68, 70 of the downhole tool 28. For clarity with the discussion, the first end 68 may be referred to as the uphole side while the second end 70 may be referred to as the downhole side, however this terminology should not be construed as limiting as either end of the downhole tool 28 may be the uphole or downhole end and such arrangement may be determined by the orientation of the sensors coupled to the arms 60. Each of the illustrated bulkheads 66 include apertures 72 which may be utilized to route or otherwise direct cables coupled to the sensors arranged on the arms 60 into the tool body for information transmission to the surface 18, for example to the controller 40. It should be appreciated that each bulkhead 66 may include a predetermined number of apertures 72, which may be based at least in part on a diameter 74 of the downhole tool 28. Accordingly, embodiments of the present disclosure provide the advantage of enabling more sensors than traditional downhole expandable tools because of the presence of the pair of bulkheads 66. As will be described below, traditional tools may include a single bulkhead and a moving pivot block to facilitate expansion and contraction of arms for moving the sensors into the annulus. The end with the moving pivot block typically does not include a bulkhead due to the lateral movement of the pivot block along the tool string axis 62, which increases the likelihood that cables are damaged because of the increased movement.

In various embodiments, the one or more sensors may include flow sensors to measure speed of flow, composition sensors to determine the amount of gas or liquid in the flow, and/or resistivity sensors to determine the make of the flow (e.g., hydrocarbon or water). Additionally, these sensors are merely examples and additional sensors may be used. The bulkhead 66 may receive a sensor tube, cable, or wire coupled to the one or more sensors and includes electronics to analyze and/or transmit data received from the sensors to a surface. The illustrated bulkheads 66 are fixed. That is, the illustrated bulkheads 66 move axially with the downhole tool 28 and do not translate independently along the tool string axis 62. As a result, the cables coupled to the sensors may be subject to less movement and pulling, which may increase the lifespan of the cables.

FIG. 2 further illustrates a pair of pivot blocks 76 arranged on the downhole tool 28. In the illustrated embodiment, the pivot blocks 76 are positioned between the bulkheads 66 and proximate a respective bulkhead 66. The pivot blocks 76 are coupled to the arms 60 at both ends to drive movement of the arms 60 between the illustrated expanded position, a stored position (not shown), and intermediate radial positions therebetween. The illustrated pivot blocks 76 include channels 78 to direct the sensor tube, cable, wire, or the like coupled to the one or more sensors toward the bulkhead 66, for example toward the aperture 72. It should be appreciated that, in various embodiments, there are an equal number of channels 78 and apertures 72. However, there may be more or fewer channels 78 and/or apertures 72. The illustrated pivot blocks 76 are fixed and do not move independently along the tool string axis 62. Rather, the pivot blocks 76 move with the tool string as the downhole tool 28 is inserted and removed from the wellbore 14. As described above, movement of the pivot blocks 76 in traditional systems may fatigue or position the cables such that damage may occur. However, providing a fixed position for the pivot blocks 76 protects the cables by reducing the amount of movement or flexion they may be exposed to.

The illustrated embodiment includes the arms 60 having a first segment 80 coupled to the pivot block 76A and a second segment 82 coupled to the pivot block 76B. The first and second segments 80 may be rotationally coupled to the respective pivot blocks 76 via a pin or journal coupling 84. However, pin and/or journal couplings are for illustrative purposes only and any reasonable coupling member to facilitate rotational movement of the first and second segments 80, 82 may be utilized. As will be described in detail below, rotational movement of the first and second segments 80, 82 move the arms 60 radially outward from the tool string axis 62. In various embodiments, a degree of relative motion of the first and second segments 80, 82 may be limited, for example by one or more restriction components, to block over-rotation of the first and second segments 80, 82. Furthermore, other components of the arms 60 may act to restrict the range of rotation of the first and second segments 80, 82.

The arms 60 further include a link arm 86, which is also coupled to the pivot block 76. As illustrated, the first and second segments 80, 82 are coupled to a respective far end 88 of the respective pivot block 76 while the link arm 86 is coupled to a respective near end 90 of the respective pivot block 76. The far end 88 is closer to the bulkhead head 66 than the near end 90. The link arm 86 is further coupled to the pivot block 76 via a pin or journal coupling 92, which may be a similar or different coupling than the coupling 84. The link arms 86 extend to couple to a telescoping section 94, for example via a pin or journal coupling 96. As illustrated, the first and second segments 80, 82 also couple to the telescoping section 94, for example via a pin or journal coupling 98, at opposite ends.

It should be understood that, in various embodiments, the illustrated couplings between the first and second segments 80, 82, the link arms 86, the telescoping section 94, and/or the pivot block 76 may enable rotation about a respective axis. That is, the components may pivot or otherwise rotate relative to one another. In certain embodiments, the couplings may include pin connections to enable rotational movement. Furthermore, in certain embodiments, the components may include formed or machined components to couple the arms together while further enabling rotation, such as a rotary union or joint, sleeve coupling, or the like.

In the embodiment illustrated in FIG. 2 where the arms 60 are arranged in the expanded position, the combination of the first segment 80, the second segment 82, the link arms 86, and the telescoping section 94 generally form a parallelogram. As will be described in detail below, the telescoping section 94 includes a first section 100 and a second section 102 that are moveable relative to one another, via a telescoping mechanism, in response to rotation of the first and second segments 80 and/or link arms 86. In other words, the telescoping section 94 moves between an expanded position and a collapsed position based on the radial position of the arm 60 (e.g., one or more components of the arm 60).

In embodiments, properties of the arms 60, such as a length of the first segment 80, a length of the second segment 82, a length of the link arm 96, or a length of the telescoping section 94 may be particularly selected to control the radial position of the telescoping portion 94 with respect to the tool string axis 62. For example, the length of the first and second segments 80, 82 and the link arm 86 directly impact the radial position of the telescoping portion 94. In this manner, the position of the telescoping portion 94, and therefore the sensors coupled to the telescoping portion 94, may be designed prior to deploying the downhole tool 28. Furthermore, any number of sensors may be arranged on the arms. It should be appreciated that the sensors are not illustrated in FIG. 2 for clarity. In various embodiments, each arm 60 contains three sensors (e.g., flow, resistivity, composition), thereby performing a total of 18 different measurements with the illustrated downhole tool 28. The downhole tool 28 illustrated in FIG. 2 enables measurements at various locations in the annulus around the downhole tool 28, thereby providing information about flow characteristics at various circumferential positions in the annulus. As opposed to using multiple downhole tools over a vast length of a tool string, the illustrated downhole tool 28 measures and records flow conditions at a particular location in the wellbore 14 over substantially the entire annulus. In certain embodiments, the sensor tubes coupling the one or more sensors to the bulkheads 66 may be equally divided. In other embodiments, more or fewer sensor tubes may be coupled to one bulkhead 66.

FIGS. 3-8 are isometric views of embodiments of the arm 60 moving between the retracted position (e.g., stored position) and the extended position (e.g., deployed position). It should be appreciated that a single arm 60 is illustrated in FIGS. 3-8 for clarity, but as described above, the downhole tool 28 may include multiple arms 60.

Figure 3:
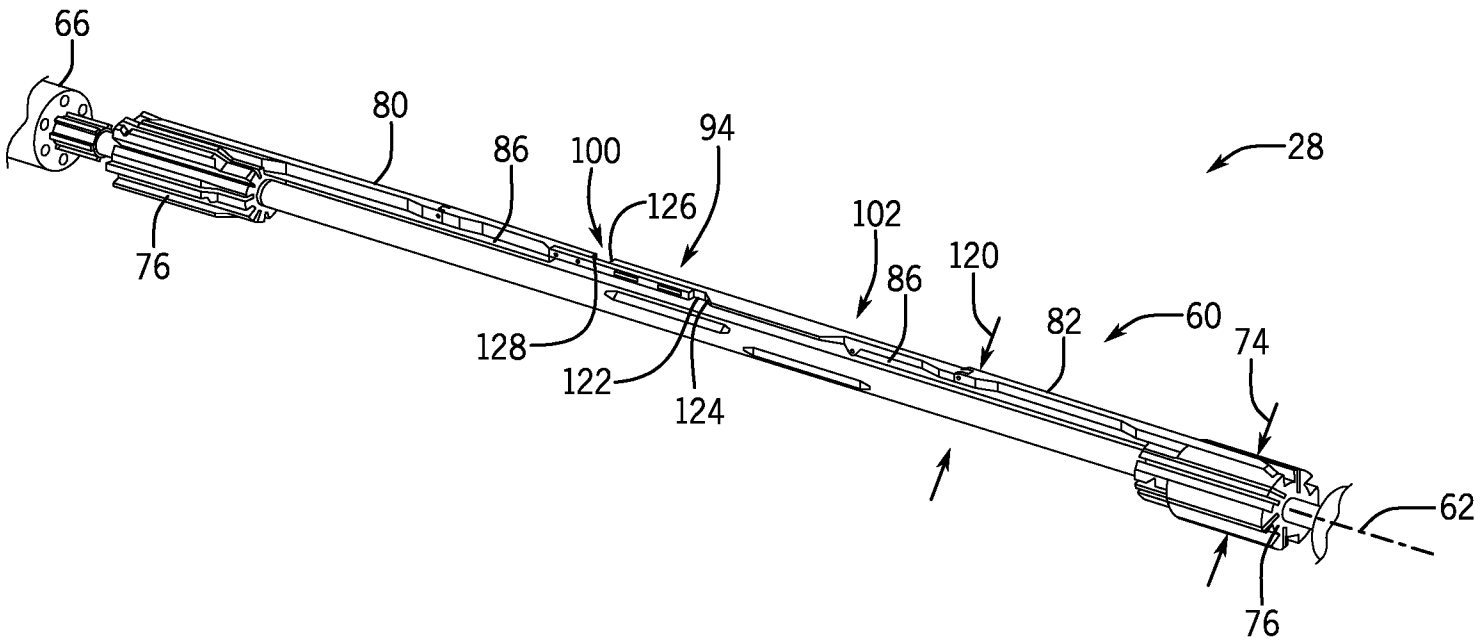
FIG. 3 is an isometric view of an embodiment of a downhole tool having an arm in a stored position, in accordance with embodiments of the present disclosure.

FIG. 3 illustrates the arm 60 in the retracted position. Because wellbores may have a small diameter, the retracted position is configured to arrange the arm 60 as close to the tool string and/or tool string axis 62 as possible to facilitate insertion into and removal from the wellbore 14. In other words, the arm 60 is arranged such that the diameter 74 of the tool is substantially equal to the diameter 120 at the arm(s) 60. As will be described below, biasing members may drive the arm 60 radially outward from the retracted position. The embodiment illustrated in FIG. 3 includes the telescoping section 94, link arms 86, first segment 80, and the second segment 82 arranged substantially parallel to the tool string axis 62. Furthermore, the first and second sections 100, 102 of the telescoping portion are in a collapsed position. In various embodiments, the collapsed position drives an end 122 of the first section 100 against a stop of the second section 124 and an end 126 of the second section 102 against a stop 128 of the first section 100. However, it should be appreciated that other stops and/or restriction members may be utilized to arrange the telescoping section 94 in the collapsed position.

Figure 4:
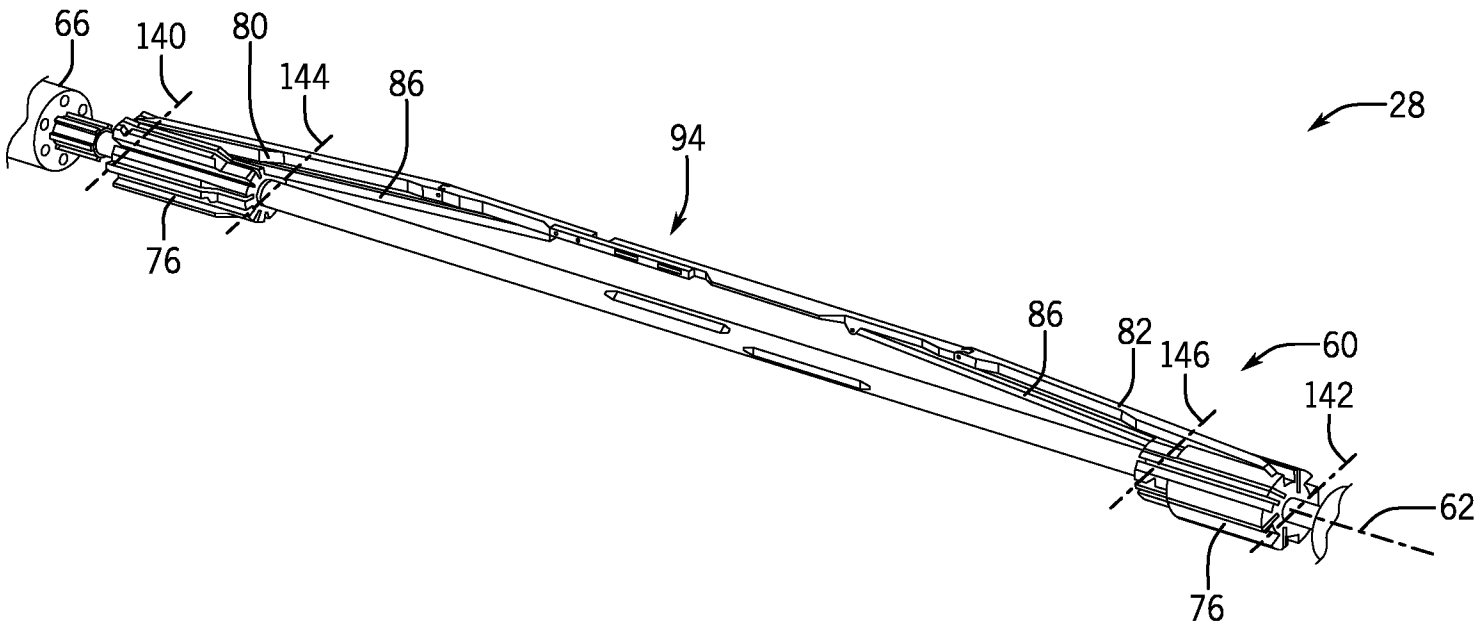
FIG. 4 is an isometric view of an embodiment of a downhole tool having an arm between a stored position and an extended position, in accordance with embodiments of the present disclosure.

FIG. 4 illustrates movement of the arm 60 driven by the force of the biasing member (not pictured). As illustrated, the telescoping section 94 is positioned substantially parallel to the tool string axis 62. The first and second segments 80, 82 rotate about respective axes 140, 142 at the pivot blocks 76. Furthermore, the link arms 86 rotate about respective axes 144, 146 at the pivot blocks 76. In various embodiments, the first and section segments 80, 82 and links arms 86 may also rotate about the respective couplings at the telescoping section 94. As illustrated, rotation of the respective components drives a change in the radial position of the telescoping section 94 relative to the tool string axis 62.

Figure 5:
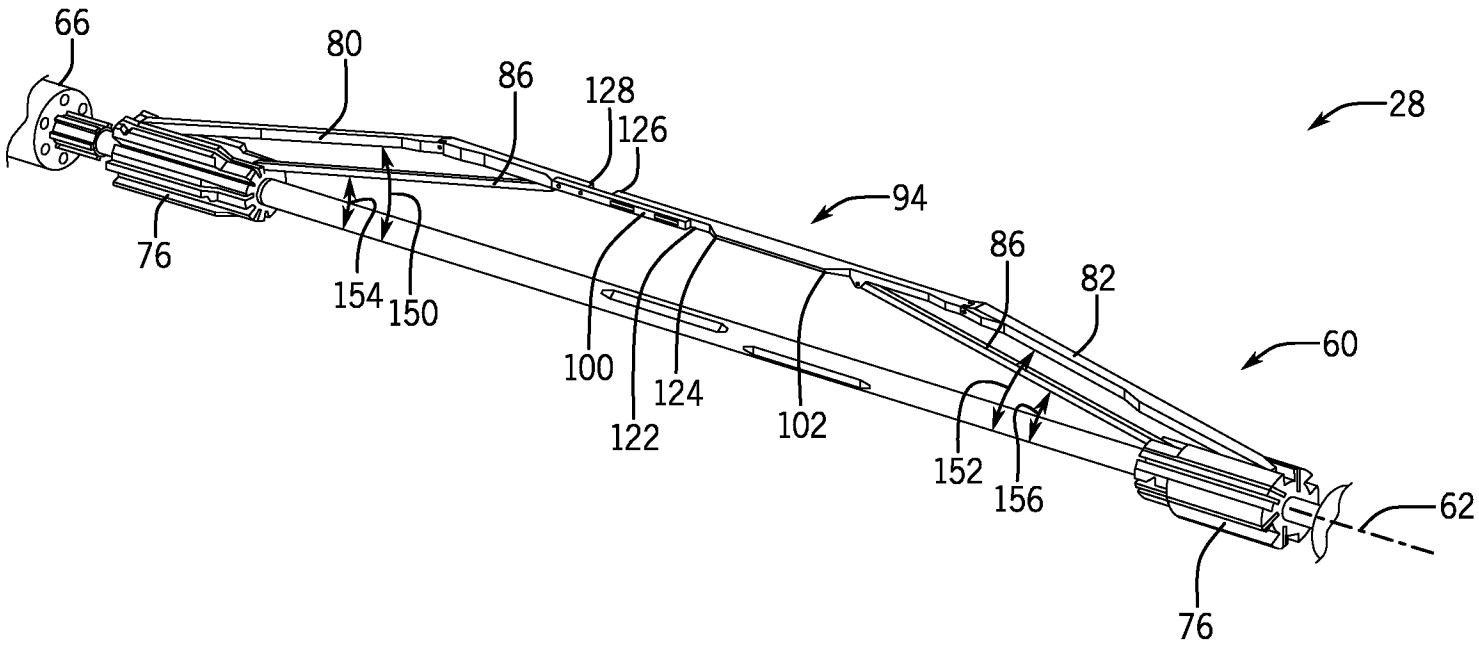
FIG. 5 is an isometric view of an embodiment of a downhole tool having an arm between a stored position and an extended position, in accordance with embodiments of the present disclosure.

FIG. 5 illustrates further radial movement of the telescoping section 94 relative to the tool string axis 62 as the biasing member drives the first and second segments 80, 82 and link arm 86 to rotate about the respective pivot points on the pivot block 66. As illustrated, the telescoping section 94 remains substantially parallel to the tool string axis 62. It should be appreciated that, in certain embodiments, the one or more sensors may be coupled to the telescoping portion, such as a flow meter. By arranging the flow meter substantially parallel to the tool string axis 62, the flow meter will be positioned substantially parallel to the flow of the fluid in the wellbore annulus. As the radial movement of the telescoping portion 94 increases away from the tools string axis 62, the first and second sections 100, 102 of the telescoping portion transition toward the extended position. That is, the first and second sections 100, 102 move away from one another such that the ends 122, 126 are no longer in contact with the stops 124, 128. Moreover, as the arms 60 move toward the expanded position an angle 150 of the first segment 80, an angle 152 of the second segment 82, and an angle 154, 156 of the links arms 86, with respect to the tool string axis 62, increases. In various embodiments, the angles 150 and 152 and the angles 154, 156 may be substantially equal. However, in other embodiments, the angles 150, 152 and the angles 154, 156 may not be equal.

Figure 6:
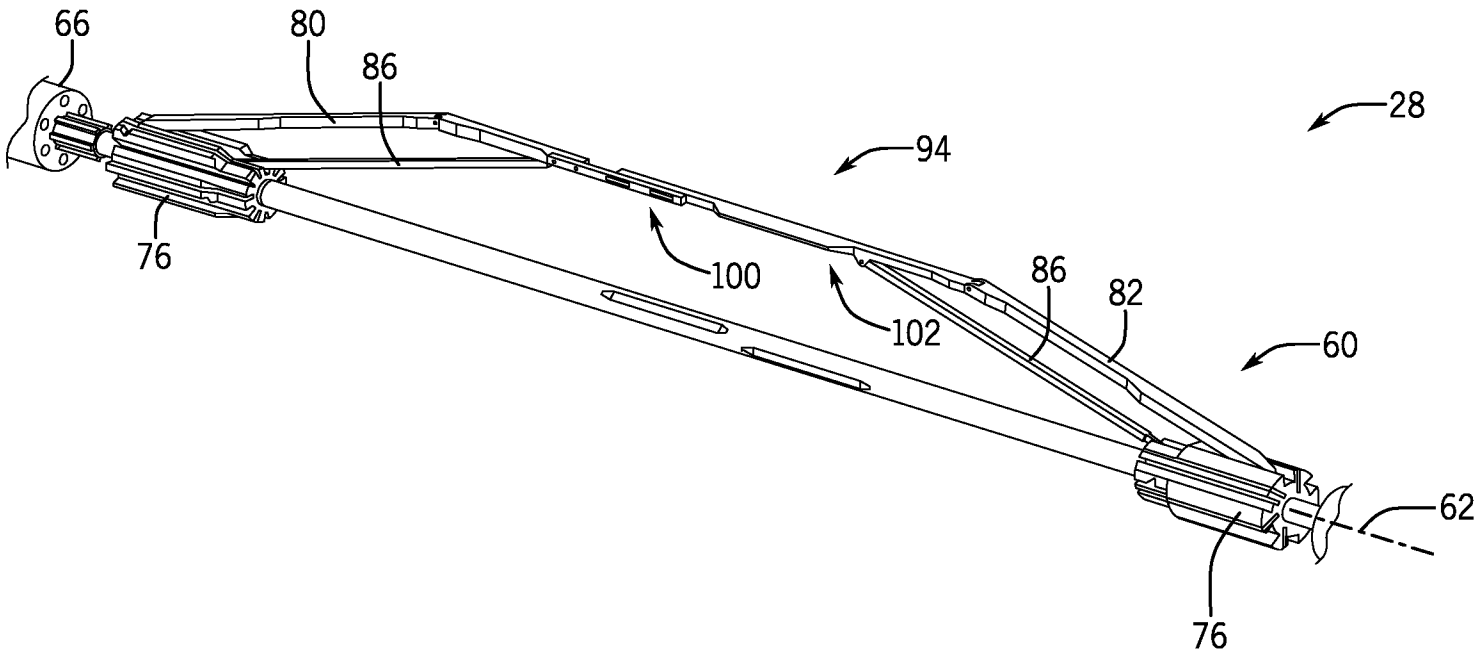
FIG. 6 is an isometric view of an embodiment of a downhole tool having an arm between a stored position and an extended position, in accordance with embodiments of the present disclosure.

FIG. 6 illustrates continued movement of the arm 60 to the expanded position. The illustrated embodiment includes the parallelogram linkage formed between the first section 80, the second segment 82, the link arms 86, the telescoping section 94, and the pivot blocks 76. As the first segment 80, links arms 86, and second segment 82 rotate about the respective pivot points, a force is applied to the telescoping portion 94 (e.g., to the ends of the first and second sections 100, 102) to pull the first and second sections 100, 102 away from one another to thereby transition toward the extended position. As will be described below, the first and second sections 100, 102 may be coupled via a sliding coupling, such as a tongue and fork slider, tongue and groove arrangement, telescoping rod, or the like. The force applied to the first and second sections 100, 102 may overcome a static friction between the components to drive movement toward the extended position.

Figure 7:
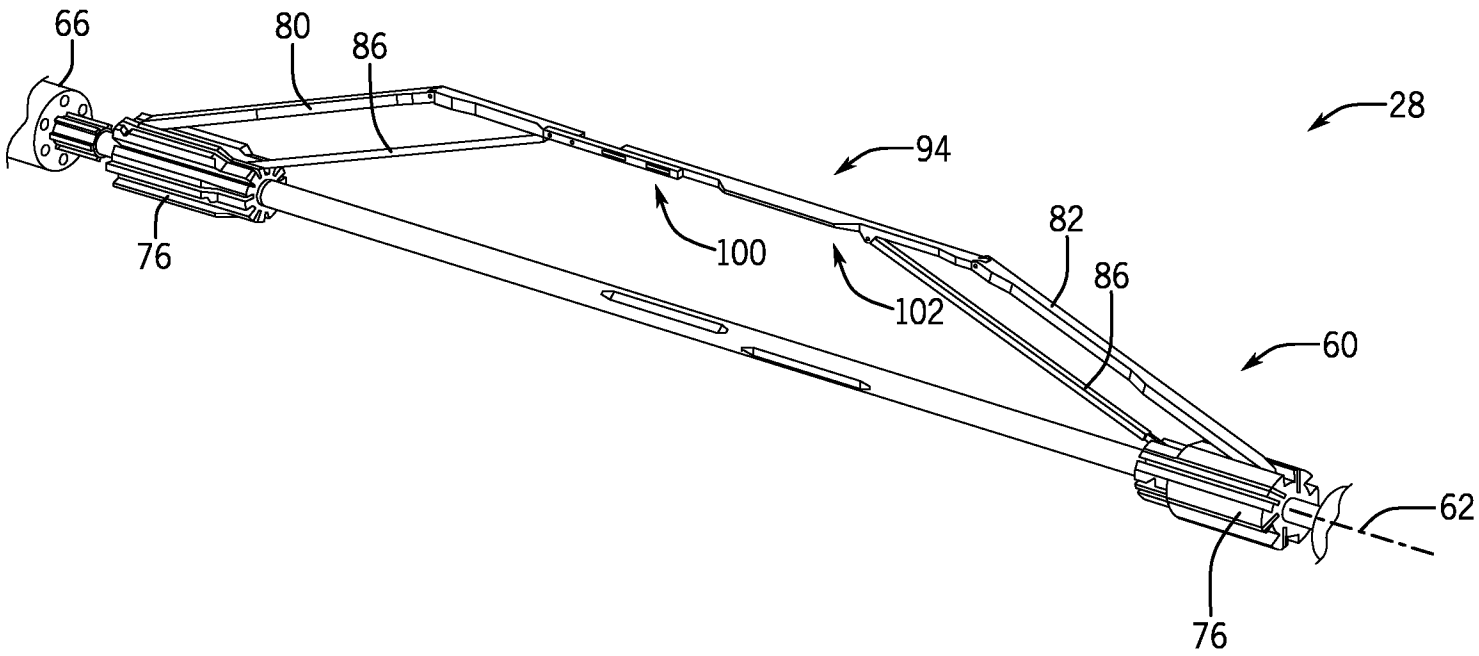
FIG. 7 is an isometric view of an embodiment of a downhole tool having an arm between a stored position and an extended position, in accordance with embodiments of the present disclosure.

FIG. 7 illustrates continued movement of the arm 60 to the expanded position. The telescoping portion 94 is arranged substantially parallel to the tool string axis 62 and the radial position of the telescoping portion 94 is further outward from the tool string axis 62 than the positions illustrated in FIGS. 3-6. As described above, it may be desirable to maintain the telescoping portion 94 at substantially a parallel position to the tool string axis 62 to thereby position the one or more sensors into the annulus.

Figure 8:
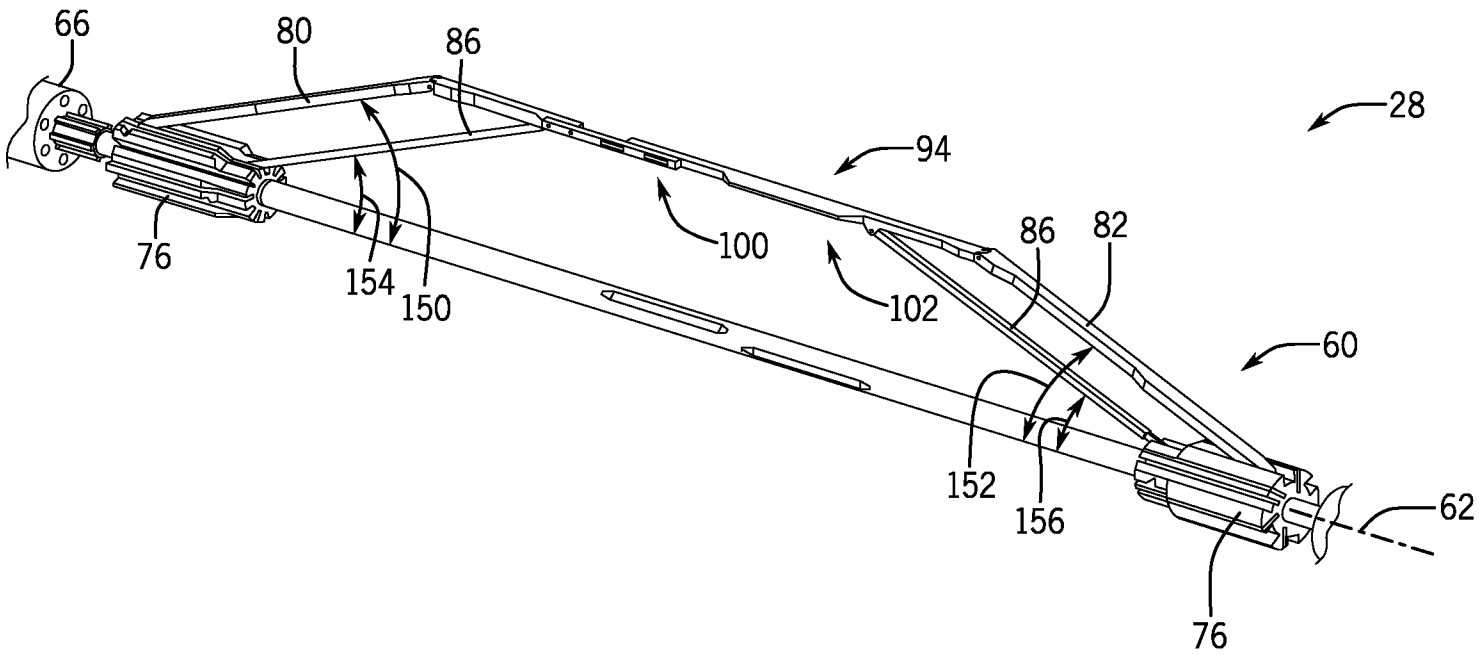
FIG. 8 is an isometric view of an embodiment of a downhole tool having an arm in an extended position, in accordance with embodiments of the present disclosure.

FIG. 8 illustrates the arm 60 in the expanded position. The parallelogram linkage drives the telescoping portion 94 radially outward from the tool string axis 62 and positions the telescoping portion 94 substantially parallel to the tool string axis 62. The first segment 80 is positioned at the angle 150 with respect to the tool string axis 62, the second segment 82 is positioned at the angle 152 with respect to the tool string axis 62, and the link arms 86 are positioned at the angles 154, 156 with respect to the tool string axis 62. The illustrated angles 150, 152, 154, and 156 are larger than in FIGS. 3-7 due to the rotational movement about the respective pivot points driven by the biasing members. As such, the telescoping portion 94 is at the extended position. In embodiments, the telescoping portion 94 may include one or more limiters to block further extension of the telescoping portion. It should be appreciated that outward forces (e.g., forces acting radially inward toward the tool string axis 62), such as the force of the formation against the arm 60, will drive the arm 60 back toward the retracted position. For example, as the downhole tool 28 is removed from the wellbore 14 the diameter of the wellhead assembly may decrease such that a force drives the arms 60 back to the retracted position.

Figure 9:
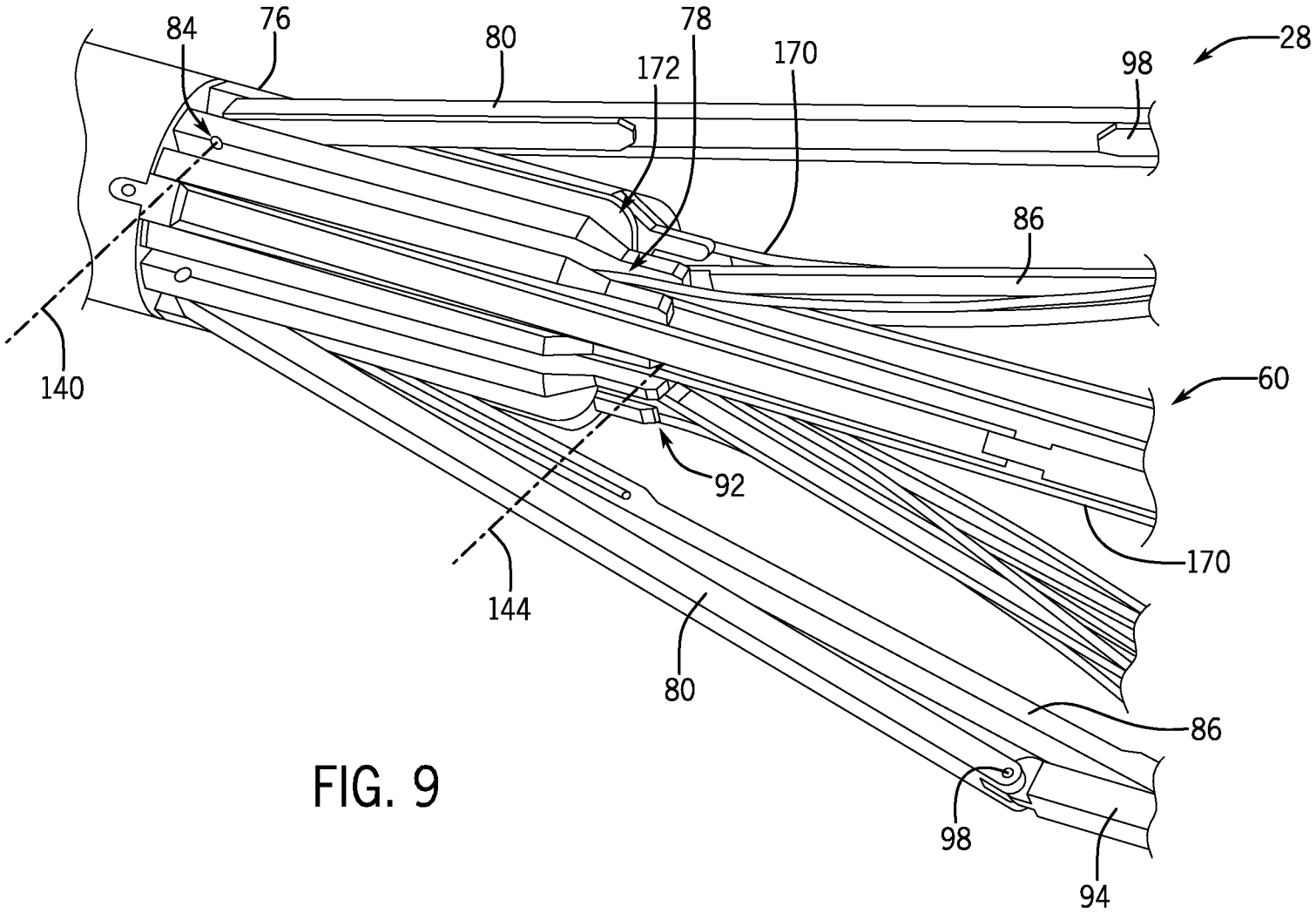
FIG. 9 is a detailed isometric view of an embodiment of a pivot block coupled to a plurality of arms, in accordance with embodiments of the present disclosure.

FIG. 9 is a partial detailed isometric view of an embodiment of the downhole tool 28 illustrating the pivot block 76. In the illustrated embodiment, the pivot block 76 includes channels 78 to direct flexible sensor tubes 170 toward the bulkhead 66. In embodiments, the flexible sensor tubes 170 extend to the one or more sensors arranged on the first segment 80, second segment 82, link arm 86, and/or telescoping section 94. The pivot block 76 also includes the pivot points 84, 92 for coupling the first segment 80 and the link arm 86, respectively. In the illustrated embodiment, the first segment 80 and the link arm 86 are both rotating about respective axes 140, 144 to transition the arm 60 to the extended position. In various embodiments, the first segment 80 may store into a recess 172 formed in the pivot block 76 when in the retracted position. In the illustrated embodiment, each first segment 80 has a respective recess 172 for reach respective arm. However, in various embodiments, the recess 172 may accommodate more than one first segment 80. As a result, the outer diameter 120 may be reduced.

FIG. 9 further illustrates the coupling 98 between the first segment 80 and the telescoping section 94. As described above, in various embodiments the coupling 98 may be a pin coupling or any type of rotatable coupling to facilitate rotation of the first segment 80 with respect to the telescoping section 94.

Figure 10:
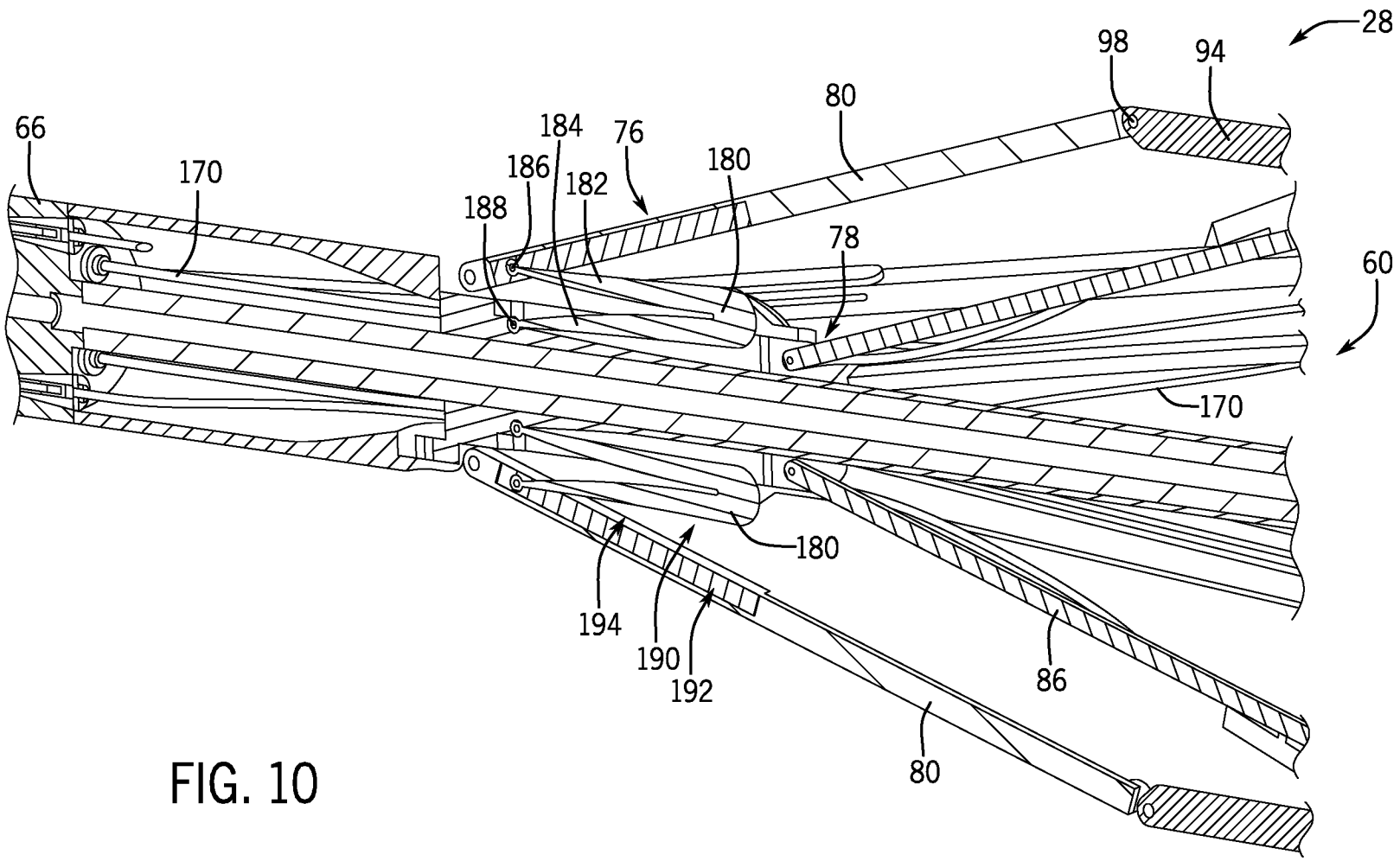
FIG. 10 is partial cross-sectional view of an embodiment of a downhole tool, in accordance with embodiments of the present disclosure.

FIG. 10 is a partial cross-sectional view of an embodiment of the downhole tool 28 illustrating the bulkhead 66, the pivot block 76, and biasing members 180 coupled to the first segment 80. The bulkhead 66 receives the flexible sensor tubes 170 from the channels 78 of the pivot block 76 via the apertures 72 for coupling to one or more controllers 40 containing electronics, such as microprocessors and non-transitory machine readable memory. The bulkhead 66 may include one or more seals to block fluid ingress toward the electronics.

The illustrated embodiment further includes the biasing member 180 arranged to couple to the first segment 80 and the pivot block 76. In various embodiments, the biasing member 180 is a leaf spring, which may be thin, to thereby facilitate placement on the pivot block 76. As shown in FIG. 10, the biasing member 180 is coupled to a single arm 60, thereby enabling independent movement of the arms 60 relative to the tool string axis 62. Advantageously, such an arrangement enables the arms 60 to deploy radially at different positions in the event that the wellbore 14 is not uniform.

The illustrated biasing member 180 is shown in a partially uncoiled or partially uncompressed position where a force is applied to the first segment 80. In various embodiments, the biasing member 180 includes first and second extensions 182, 184 for coupling to the first segment 80 and the pivot block 76. The respective couplings 186, 188 may be rigid or enable rotation between the biasing member 180 and the first segment 80 and/or the pivot block 76. In certain embodiments, a force provided by the biasing member 180 is particularly selected to drive the arms 60 to a predetermined radial position relative to the tool string axis 62. In this manner, outward movement of the arm 62 may be facilitated without utilizing motors or powered drivers.

As shown, the biasing member 180 is arranged within a compartment 190 formed within the pivot block 76. The compartment 190 aligns with a respective cut out 192 in the first segment 80, thereby forming a chamber 194 for the biasing member 180. As a result, the biasing member 180, while in the compressed position, may be within the diameter 120, thereby reducing the overall diameter of the downhole tool 28.

Figure 11:
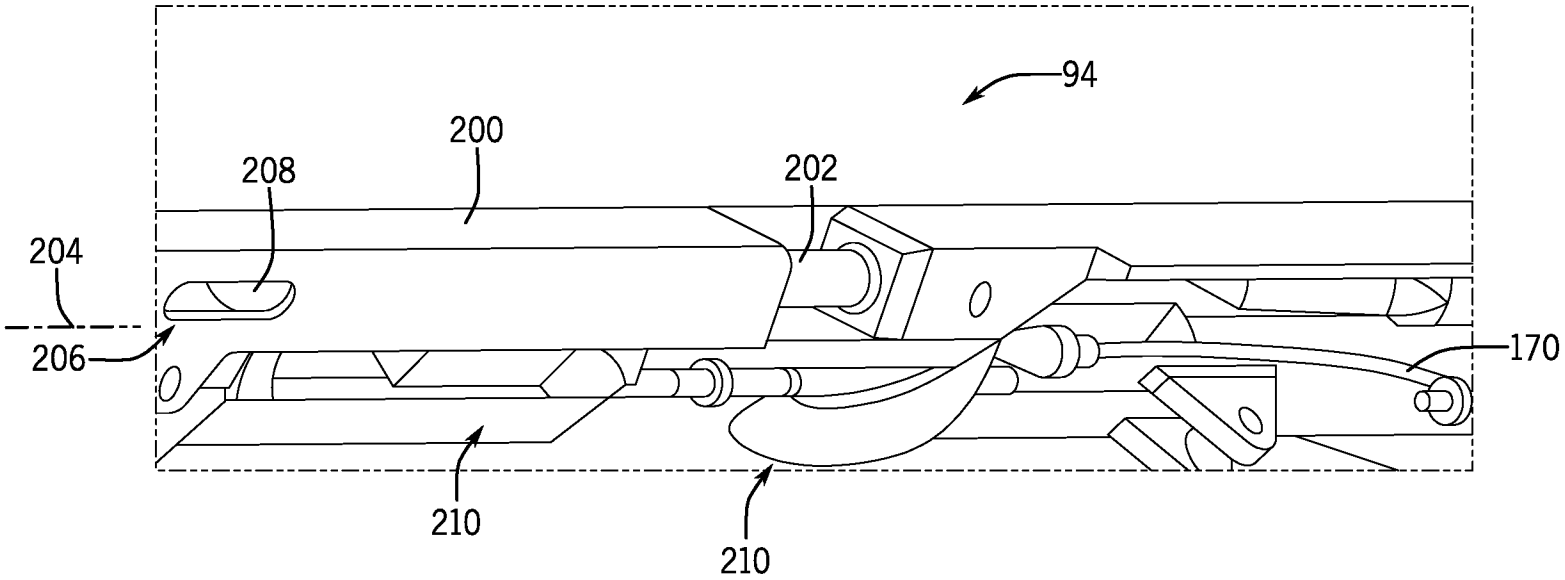
FIG. 11 is a detailed isometric view of an embodiment of a telescoping section of a downhole tool, in accordance with embodiments of the present disclosure

FIG. 11 is a detailed isometric view of an embodiment of the telescoping section 94 including an embodiment of a telescoping mechanism. In the illustrated embodiment, the telescoping section 94 includes a sleeve 200 and translatable rod 202 that moves axially along an axis 204 to facilitate extension and collapse of the telescoping section 94. In the illustrated embodiment, the sleeve 200 includes an aperture 206 to facilitate removal of debris, which may accumulate due to fluid flow in the annulus. Furthermore, the rod 202 includes a limiting feature 208 to block over-extension of the telescoping portion. It should be appreciated that while the embodiment illustrated in FIG. 10 includes a telescopic slide. In other embodiments, the telescoping section 94 may include other mechanisms to facilitate extension and collapse of the telescoping section 94. For example, the telescoping section 94 may include a tongue and groove fitting having one or more bearings to facilitate extension and collapse. Additionally, the telescoping section 94 may include a guided or unguided telescopic slide.

In various embodiments, sensors 210 are arranged on the telescoping section 94, as described in detail above. For example, one illustrated sensor 210 is a flow sensor that is positioned within the annulus when the arm 60 is moved to the extended position to radially displace the telescoping section 94 from the tool string axis 62. The illustrated sensor 210 includes the sensor tube 170 for relaying information from the sensor 210 to the surface 18, for example to the controller 40. Furthermore, it should be appreciated that while the illustrated embodiment includes a single sensor 210, that in other embodiments any number of sensors 210 may be arranged on the telescoping section 94, the link arm 86, the second segment 82, and/or the first segment 80.

Figure 12:
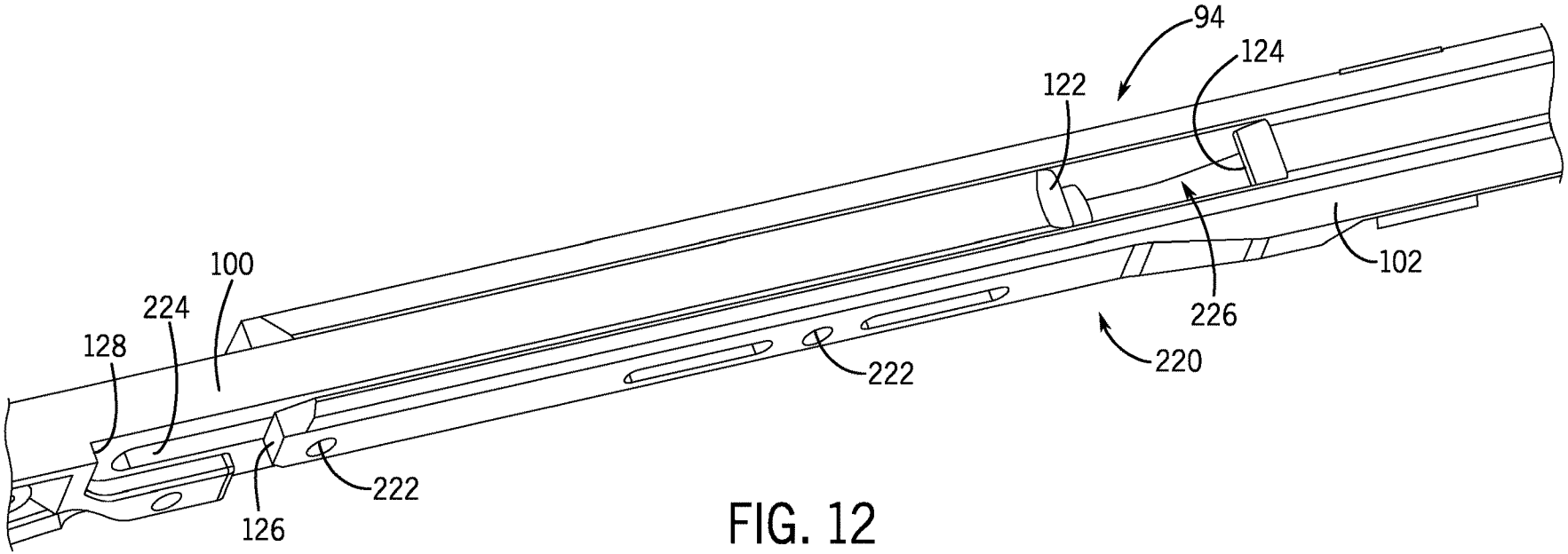
FIG. 12 is a detailed isometric view of an embodiment of a telescoping section of a downhole tool, in accordance with embodiments of the present disclosure.
Figure 13:
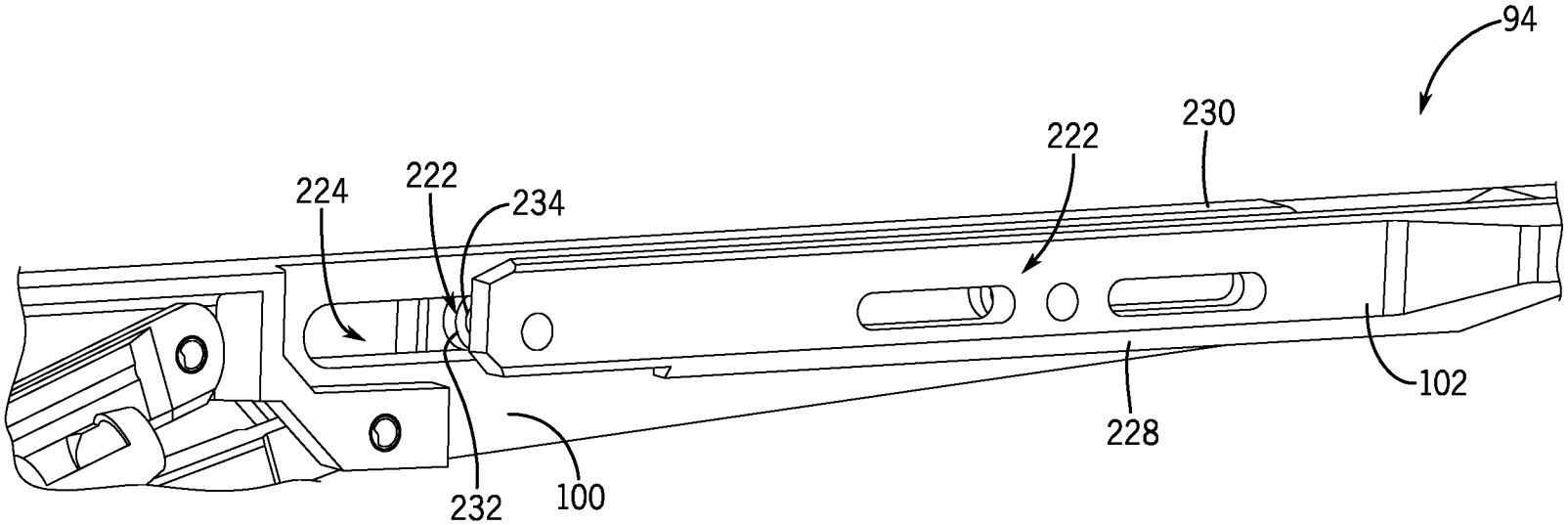
FIG. 13 is a detailed isometric view of an embodiment of a telescoping section of a downhole tool, in accordance with embodiments of the present disclosure.
Figure 14:
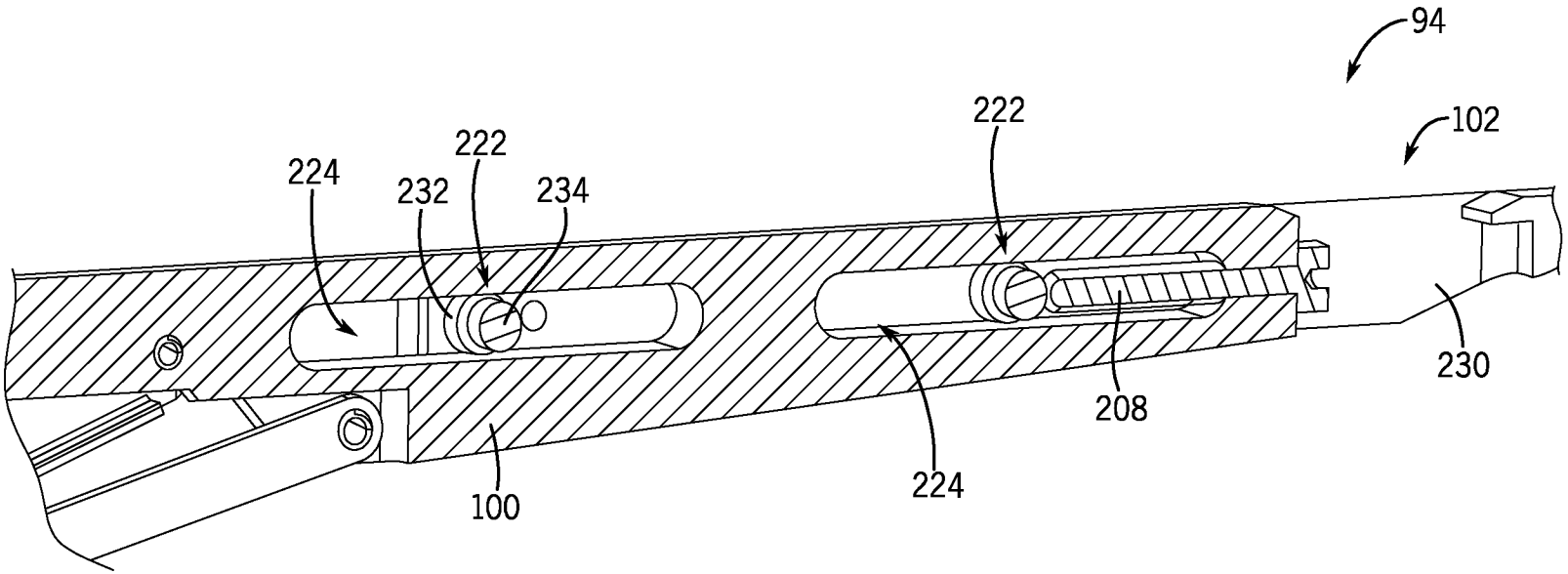
FIG. 14 is a detailed isometric view of an embodiment of a telescoping section of a downhole tool, in accordance with embodiments of the present disclosure.

FIGS. 12-14 are detailed isometric views of an embodiment of the telescoping section 94 including a telescoping mechanism illustrated as a tongue and fork mechanism 220. The tongue and fork mechanism 220 enables expansion and contraction of the telescoping section 94 and may be used in place of, or in combination with, the rod and sleeve arrangement illustrated in FIG. 12. For example, FIG. 12 illustrates the telescoping section 94 including the first section 100 and the second section 102. In the embodiments shown in FIGS.

12-14, the first section 100 may be referred to as a tongue 100 and the second section 102 may be referred to as a fork 102. In the illustrated embodiment, the tongue 100 further includes the end 122 and the stop 128 while the fork 102 includes the end 126 and the stop 124. In various embodiments, the respective ends and stops are in contact when the telescope section 94 is in the collapsed position. The embodiment illustrated in FIG. 12 further includes pins 222 that extend into a slot 224 (or any number of slots 224) formed in the tongue 100. The pins 222 are coupled to the fork 102 in the illustrated embodiment, however it should be appreciated that the pins 222 may be coupled in the tongue 100 in other embodiments. Furthermore, while not visible in FIG. 12, in various embodiments the pins 222 may be coupled on both sides of the fork 102, which receives the tongue 100 within an opening 226 in the illustrated embodiment. The pins 222 serve to guide the linear motion between the tongue 100 and the fork 102 and also serve to limit the range of travel allowed between the two.

FIG. 13 illustrates the pins 222 extending through the slot 224 to couple the opposing members 228, 230 of the fork 102 together. The illustrated embodiment includes two pins 222, however it should be appreciated, in other embodiments, 1, 3, 4, 5, or any reasonable number of pins 222 may be included. The number of pins 222 may be proportional to a length of the slot 224 to decrease a likelihood of bending or deformation. That is, a longer slot 224 may utilize more pins 222 in order to provide stability to the slot 224. As shown, the pin 222 includes a head 232 and body 234, which has a smaller diameter than the head 232. Accordingly, lateral forces applied across the pin 222 will be resisted such that the pin 222 remains within the slot 224 in a manner where the body 234 slides along the slot 224. In various embodiments, the slot 224 and/or body 234 may be treated with a dry lubricant to facilitate sliding, or each component may include a predetermined surface finish to reduce friction.

FIG. 14 illustrates a cross-sectional view of the pin 222 and slot 224 in which one of the members 228 is removed for clarity. As described above, the body 234 is positioned to slide along the slot 224 while the larger diameter head 232 blocks lateral movement of the pin 222. In the illustrated embodiment, the limiting feature 208 extends into the slot 224 to block or restrict movement of the fork 102 relative to the tongue 100. In this manner, over extension of the telescoping section 94 may be blocked, thereby reducing the likelihood of damage to the arms 60. It should be appreciated that the position of the limiting feature 208 may be adjusted based on operating conditions.

Figure 15:
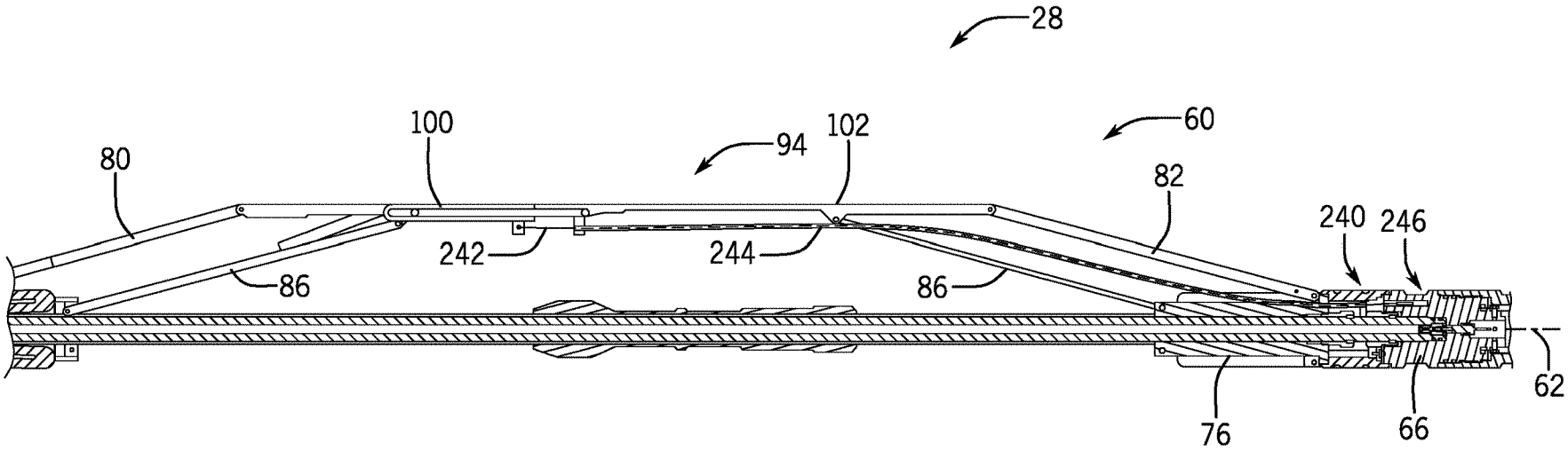
FIG. 15 is a schematic elevational view of an embodiment of a position indicator of a downhole tool, in accordance with embodiments of the present disclosure.

FIG. 15 is a schematic side elevation view of an embodiment of the arm 60 including a position indicator 240. In various embodiments, the position indicator 240 may be utilized to determine a radial position of the telescoping portion 94 relative to the tool string axis 62. As such, a wellbore diameter may be calculated by evaluating the radial positions of each arm 60 on the downhole tool 28. In the illustrated embodiment, the position indicator 240 includes a measure wire 242 and a Bowden cable 244, both extending along the arm 60 toward the bulkhead 66. As will be appreciated, the Bowden cable 244 may be a hollow cable and or sheath and the measure wire 242 may extend within the inner diameter of the Bowden cable 242. In various embodiments, the measure wire 242 is coupled to the first section 100 while the Bowden cable 244 is coupled to the second section 102. As a result, the measure wire 242 and the Bowden cable 244 move relative to one another.

In various embodiments, the measure wire 242 is coupled to a linear variable differential transformer (LVDT) 246. For example, the measure wire 242 may be coupled to an iron core positioned within a wound coil of the LVDT 246. As will be appreciated, movement of the core will induce an electric current, which may be measured and correlated to the radial position of the telescoping section 94. In various embodiments, the LVDT 246 is arranged within an aperture 74 of the bulkhead 66.

Figure 16:
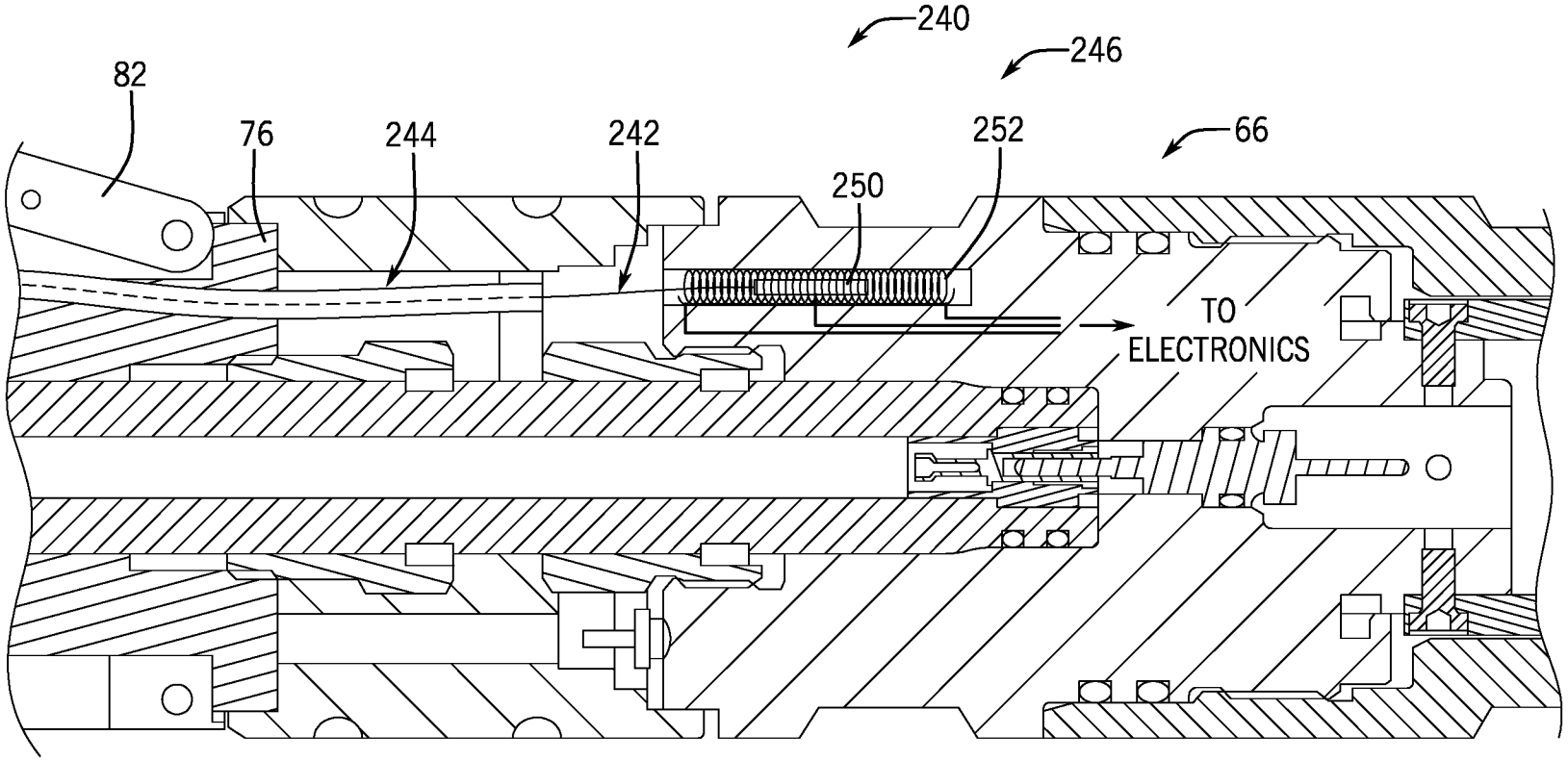
FIG. 16 is a cross-sectional view of an embodiment of a bulkhead having a position indictor, in accordance with embodiments of the present disclosure.

FIG. 16 is a schematic cross sectional view of an embodiment of the bulkhead 66 include the LVDT 246. In the illustrated embodiment, the Bowden cable 244 extends to the aperture 72 along with the measure wire 242. As shown, the measure wire 242 is coupled to a ferrous core 250, which may be translatable within the opening formed in the bulkhead 66. The LVDT 246 further includes a coil 252 wound around the ferrous core 250. Linear movement of the ferrous core 250 will induce an electrical current within the coil 252, which may be measured, for example at the surface 18 via the controller 40. Accordingly, as the first section 100 moves away from the second section 102, the measure wire 242 may pull the ferrous core 250 linearly through the coil 252, thereby inducing the electric current. In this manner, the radial position of the telescoping section 94 may be determined by correlating the position of the first section 100 relative to the second section 102.

Figure 17:
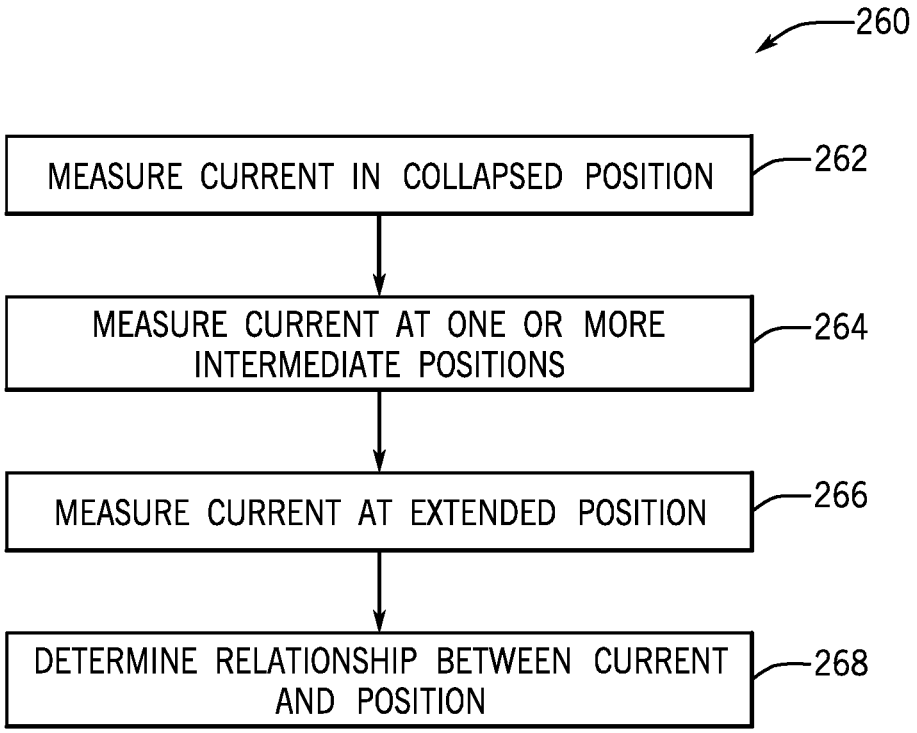
FIG. 17 is a flow chart of an embodiment of a method for determining a position of an arm of a downhole tool, in accordance with embodiments of the present disclosure.

FIG. 17 is a method 260 for determining a radial position of the telescoping section 94. It should be understood that, for any process or method described herein, that there can be additional, alternative, or fewer steps performed in similar or alternative orders, or concurrently, within the scope of the various embodiments unless otherwise specifically stated. In various embodiments, the current in the coil 252 is determined in the collapsed position (block 262). For example, the current may be equivalent to approximately zero due to the position of the ferrous core 250. Next, the current is measured at one or more intermediate positions (block 264). In various embodiments, the current in the coil 252 may be measured at various positions of extension of the arms 60. Thereafter, the current in the coil 252 may be measured at the extended position (block 266). Accordingly, once the data points are determined, the relationship between current and the radial position of the telescoping section 94 may be determined (block 268). As such, a correlation between the current from the coil 252 and the radial position of the telescoping section 94 may be used to determine the position of the arms 60.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A sensor deployment system, comprising:

a pair of bulkheads arranged along a tool string axis;

a pair of pivot blocks arranged along the tool string axis, a respective pivot block of the pair of pivot blocks being positioned proximate a respective bulkhead of the pair of bulkheads, the pivot blocks being axially fixed relative to the pair of bulkheads; and an arm coupled to the pair of pivot blocks at opposite ends, the arm comprising:

a first segment rotationally coupled to a first pivot block of the pair of pivot blocks;

a second segment rotationally coupled to a second pivot block of the pair of pivot blocks;

a first link arm coupled to the first pivot block and the first segment;

a second link arm coupled to the second pivot block and the second segment; and a telescoping section extending between the first segment and the second segment, wherein the telescoping section moves radially outward from the tool string axis as the first and second segments rotate about the respective pivot blocks, an axis extending along a length of the telescoping section being maintained substantially parallel to the tool string axis.

2. The sensor deployment system of claim 1, wherein a sensor is coupled to at least one of the first segment, the second segment, the first link arm, the second link arm, or the telescoping section.

3. The sensor deployment system of claim 1, further comprising a position indicator arranged along the arm, the position indicator measuring a radial position of the telescoping portion with respect to the tool string axis.

4. The sensor deployment system of claim 3, wherein the position indicator comprises:

a measure wire extending along at least a portion of the arm to the bulkhead;

a Bowden cable extending along at least a portion of the arm to the bulkhead, wherein at least a portion of the measure wire is within the Bowden cable; and a linear variable differential transformer coupled to the measure wire.

5. The sensor deployment system of claim 1, further comprising:

a telescoping mechanism arranged on the telescoping section to move a first section of the telescoping section away from a second section of the telescoping section in response to radial movement of the telescoping section away from the tool string axis.

6. The sensor deployment system of claim 1, wherein the first segment is rotationally coupled to the telescoping section and the second segment is rotationally coupled to the telescoping section.

7. The sensor deployment system of claim 1, wherein the first segment is rotationally coupled to the pivot block at a first end and the first link arm is rotationally coupled to the pivot block at a second end, the first end being closer to the bulkhead than the second end.

8. The sensor deployment system of claim 1, wherein the pair of bulkheads and the pair of pivot blocks are axially fixed along the tool string axis.

9. The sensor deployment system of claim 1, further comprising:

a biasing member coupled between the first segment and the pivot block, the biasing member driving rotational movement of the first segment about the pivot block to move the telescoping section radially outward from the tool string axis.

10. A sensor deployment system comprising:

a first bulkhead arranged at a first end of a downhole tool, the first bulkhead facing in a downhole direction;

a second bulkhead arranged at a second end of the downhole tool, opposite the first end, the second bulkhead facing in an uphole direction, opposite the downhole direction;

a first pivot block arranged proximate the first bulkhead, the first pivot block being axially fixed relative to the first bulkhead;

a second pivot block arranged proximate the second bulkhead, the second pivot block being axially fixed relative to the second bulkhead;

an arm rotatably coupled to the first and second pivot blocks at opposite ends of the arm, wherein rotation of at least a portion of the arm drives at least a portion of the arm radially outward from an axis of the downhole tool, and a biasing member coupled between the arm and the first pivot block, the biasing member driving rotational movement of the arm about the first pivot block to change a radial position of at least a portion of the arm with respect to the axis.

11. The sensor deployment system of claim 10, wherein the arm further comprises:

a first segment coupled to the first pivot block;

a second segment coupled to the second pivot block;

a link arm coupled to the first pivot block; and a telescoping section between the first and second segments, the telescoping section being substantially parallel to the axis as the telescoping section moves radially outward from the axis.

12. The sensor deployment system of claim 11, wherein the telescoping section comprises:

a first section coupled to the first segment; and a second section coupled to the second segment;

wherein the first section and the second section are arranged to move axially relative to one another as a radial position of the telescoping section relative to the axis changes.

13. The sensor deployment system of claim 11, further comprising:

a sensor is coupled to at least one of the first segment, the second segment, the link arm, or the telescoping section.

14. The sensor deployment system of claim 10, further comprising:

a position indicator, the position indicator measuring a radial position of at least a portion of the arm with respect to the axis.

15. A downhole measurement system, comprising:

a bottom hole assembly arranged within a wellbore;

a conveying member extending from a surface to the bottom hole assembly, the conveying member controlling a position of the bottom hole assembly within the wellbore; and a downhole tool, the downhole tool being part of the bottom hole assembly and positioning at least one sensor into an annulus of the wellbore, the downhole tool comprising:

a first pivot block axially fixed at a first end;

a second pivot block axially fixed at a second end, opposite the first end;

an arm rotatably coupled to the first and second pivot blocks, wherein rotation of the arm around at least one of the first or second pivot blocks changes a radial position of at least a portion of the arm with respect to a tool axis such that the at least one sensor is positioned within the annulus; and a telescoping section of the arm, wherein the telescoping section comprises first and second sections that move axially to one another as the radial position of the arm changes with respect to the tool axis.

16. The downhole measurement system of claim 15, further comprising:

a first bulkhead arranged proximate the first pivot block; and a second bulkhead arranged proximate the second pivot block;

wherein the first bulkhead, the second bulkhead, the first pivot block, and the second pivot block are all axially fixed along the tool axis.

17. The downhole measurement system of claim 15, further comprising:

a position indicator, the position indicator measuring the radial position of the arm via detection of the movement between the first and second sections of the telescoping section.

18. The downhole measurement system of claim 15, further comprising:

a biasing member coupled between the arm and the first pivot block, the biasing member driving rotational movement of the arm about an arm segment axis substantially perpendicular to the tool axis.

* * * * *